US006843031B1

(12) United States Patent
Sorkin

(10) Patent No.: US 6,843,031 B1
(45) Date of Patent: Jan. 18, 2005

(54) BONDED MONOSTRAND POST-TENSION SYSTEM

(76) Inventor: Felix L. Sorkin, 13022 Trinity Dr., Stafford, TX (US) 77477

( * ) Notice: Subject to any disclaimer, the term of this patent is extended or adjusted under 35 U.S.C. 154(b) by 0 days.

(21) Appl. No.: 10/621,213

(22) Filed: Jul. 17, 2003

(51) Int. Cl.[7] ..... E04C 5/08

(52) U.S. Cl. ..... 52/223.13; 285/285.1; 403/374.2

(58) Field of Search ..... 24/122.6, 122.3, 24/136 R; 285/285.1, 295.2, 307, 903, 339; 52/223.13, 223.14, 223.1, 223.6, 223.8; 403/373, 374.1, 374.2, 374.3, 374.4, 365, 367, 368, 300, 370

(56) References Cited

U.S. PATENT DOCUMENTS 3,578,777 A * 5/1971 DeGain ..... 138/121
4,223,497 A * 9/1980 Edwards ..... 52/223.13
4,388,014 A * 6/1983 Wlodkowski et al. ... 403/374.2
4,680,906 A * 7/1987 Prevedini ..... 52/223.13
5,072,558 A 12/1991 Sorkin
5,271,199 A * 12/1993 Northern ..... 52/223.13
5,347,777 A * 9/1994 Sudduth ..... 52/223.13
5,606,839 A * 3/1997 Baumann ..... 52/223.8
5,701,707 A 12/1997 Sorkin
5,720,139 A 2/1998 Sorkin
6,023,894 A * 2/2000 Sorkin ..... 52/223.8
6,381,912 B1 * 5/2002 Sorkin ..... 52/223.13
6,655,104 B2 * 12/2003 Kadotani et al. ..... 52/223.13

FOREIGN PATENT DOCUMENTS

DE 3005047 A * 8/1981 ..... 52/223.13

* cited by examiner

*Primary Examiner*—Eric K. Nicholson
*Assistant Examiner*—Aaron Dunwoody
(74) *Attorney, Agent, or Firm*—Harrison & Egbert

(57) ABSTRACT

A bonded monostrand post-tension system including an anchor having a tubular extension extending therefrom, a duct having an interior passageway formed therein, a coupler having a one end affixed to the tubular extension of the anchor and another end affixed to the duct, and a single tendon secured to the anchor and extending through the duct and the coupler. The coupler has a first internal thread at one end thereof and a second internal thread at an opposite end thereof. The internal threads are in interference-fit relationship with unthreaded surfaces of the duct and the tubular extension of the anchor.

9 Claims, 2 Drawing Sheets

BONDED MONOSTRAND POST-TENSION SYSTEM

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to bonded monostrand post-tension systems. More particularly, the present invention relates to couplers whereby the anchor of such systems can be coupled to the duct which extends over a single tendon. Additionally, the present invention relates to systems whereby grout can be introduced into the interior spaces of the duct for the purposes of cementing the tendon within the duct.

BACKGROUND OF THE INVENTION

For many years, the design of concrete structures imitated the typical steel design of column, girder and beam. With technological advances in structural concrete, however, its own form began to evolve. Concrete has the advantages of lower cost than steel, of not requiring fireproofing, and of its plasticity, a quality that lends itself to free flowing or boldly massive architectural concepts. On the other hand, structural concrete, though quite capable of carrying almost any compressive load, is weak in carrying significant tensile loads. It becomes necessary, therefore, to add steel bars, called reinforcements, to concrete, thus allowing the concrete to carry the compressive forces and the steel to carry the tensile forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economic and popular. Reinforced-concrete framing is seemingly a quite simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, a mixture of water, cement, sand, and stone or aggregate, of proportions calculated to produce the required strength, is placed, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as one hundred feet can be attained in members as deep as three feet for roof loads. The basic principle is simple. In pre-stressing, reinforcing rods of high tensile strength wires are stretched to a certain determined limit and then high-strength concrete is placed around them. When the concrete has set, it holds the steel in a tight grip, preventing slippage or sagging. Post-tensioning follows the same principle, but the reinforcing tendon, usually a steel cable, is held loosely in place while the concrete is placed around it. The reinforcing tendon is then stretched by hydraulic jacks and securely anchored into place. Pre-stressing is done with individual members in the shop and post-tensioning as part of the structure on the site.

In a typical tendon tensioning anchor assembly used in such post-tensioning operations, there are provided anchors for anchoring the ends of the cables suspended therebetween. In the course of tensioning the cable in a concrete structure, a hydraulic jack or the like is releasably attached to one of the exposed ends of each cable for applying a predetermined amount of tension to the tendon, which extends through the anchor. When the desired amount of tension is applied to the cable, wedges, threaded nuts, or the like, are used to capture the cable at the anchor plate and, as the jack is removed from the tendon, to prevent its relaxation and hold it in its stressed condition.

It is highly desirable to protect the tensioned steel cables from corrosive elements, such as de-icing chemicals, sea water, brackish water, and even rain water which could enter through cracks or pores in the concrete and eventually cause corrosion and loss of tension of the cables. The cables typically are protected against exposure to corrosive elements by surrounding them with a metal duct or, more recently, with a flexible duct made of an impermeable material, such as plastic. The protective duct extends between the anchors and in surrounding relationship to the bundle of tensioning cables. Flexible duct, which typically is provided in 20 to 40 foot sections is sealed at each end to an anchor and between adjacent sections of duct to provide a water-tight channel. Grout then may be pumped into the interior of the duct in surrounding relationship to the cables to provide further protection.

The inventor also has several other patents relating to the introduction of grout into bonded systems or to the placement of ducts around tendons. For example, U.S. Pat. No. 5,720,139, issued on Feb. 24, 1998, describes a method and apparatus for installing a multi-strand anchorage system. The multi-strand anchorage system includes a anchor plate having a front side and a back side, a plurality of tendon-receiving passageways formed in the anchor plate, and a hole formed in the anchor plate and extending so as to open on a front side and a back side of the anchor plate. Each of the tendon-receiving passageways opens on the front side and opens on the back side of the anchor plate. Each of the tendon-receiving passageways tapers so as to having narrow diameter adjacent the back side of the anchor plate and a wide diameter adjacent the front side of the anchor plate. The hole is an unmachined cast hole suitable so that a grout tube can be directly placed therein to deliver grout for the purposes of cementing the multiple tendons within the duct affixed to the anchor plate.

U.S. Design Pat. No. 400,670 issued on Nov. 3, 1998, teaches a particular design of a duct as used in a multi-strand post-tension system. The design is particularly configured so that multiple tendons can be placed therein.

U.S. Pat. No. 5,701,707, issued on Dec. 30, 1997, also a teaches a bonded slab post-tension system including a transition apparatus having a diverter member. The diverter member has a first end and a second end and a tendon port support affixed to the second end of the diverter member. The first end of the diverter member is attached to a duct. The tendon port support has a plurality of tendon ports opening at an end opposite the diverter member. The second end of the diverter member has a greater area than the first end. Each of the tendon ports is of a tubular configuration opening at one end to an interior of the diverter member. A grout connection tube is affixed to a port formed on the top surface of the diverter member so as to allow for the introduction of grout into the duct and around the tendons formed therein.

U.S. Pat. No. 5,775,849, issued on Jul. 7, 1998, teaches a duct system for a post-tension rock anchorage system. This duct system has a first duct with a plurality of corrugations extending outwardly therefrom, a second duct having a plurality of corrugation extending radially outwardly therefrom, and a tubular body threadedly receiving the first duct at one end and threadedly receiving the second duct at the opposite end. The tubular body has a first threaded section formed on an inner wall of the tubular body adjacent one end of the tubular body and a second threaded section formed on an inner wall of the tubular body adjacent an opposite end of the tubular body. The threaded sections are formed of a harder polymeric material than the polymeric material of the first and second ducts. The tubular body has an outer diameter which is less than the diameter of the ducts at the corrugations. The first and second threaded sections have a maximum inner diameter which is less than the outer diameter of the ducts at the end of the ducts. First and second elastomeric seals are affixed to opposite ends of the tubular body and juxtaposed against a surface of a corrugation of the first and second ducts.

It is an object of the present invention to provided a bonded monostrand post-tension system which allows a duct to be easily coupled to an anchor.

It is another object of the present invention to provided a bonded monostrand post-tension system in which grout can be easily introduced so as to fill the spaces within the duct and around the tendon.

It is still a further object of the present invention to provided a bonded monostrand post-tension system which can provide a completely sealed system without voids between the tendon, the duct and the anchor.

It is still a further object of the present invention to provided a bonded monostrand post-tension system which is easy to use, easy to manufacture, and relatively inexpensive.

These and other objects and advantages of the present invention will become apparent from a reading of the attached specification and appended claims.

BRIEF SUMMARY OF THE INVENTION

The present invention is a bonded monostrand post-tension system that comprises an anchor having a tubular extension extending therefrom, a duct having an interior passageway formed therein, a coupler having one end affixed to the tubular extension of the anchor and another end affixed to the duct, and a single tendon secured to the anchor and extending through duct and the coupler.

In the present invention, the coupler has a first internal thread at one end and second internal thread at an opposite end. The first internal thread is engaged with the tubular extension of the anchor. The second internal thread is engaged with the exterior surface of the duct. The duct has a corrugation extending outwardly therefrom. The second internal thread is affixed to this corrugation. The anchor has a polymeric encapsulation extending thereover. The tubular extension is formed by this polymeric encapsulation. The first internal thread is self-tapped onto the tubular extension. One end of the coupler is interference-fit relationship with the tubular extension while the other end of the coupler is in interference-fit relationship with the corrugation of the duct.

The duct of the present invention is a tubular body having a plurality of corrugations extending outwardly therefrom along an exterior surface thereof. Each of plurality of corrugations is in spaced relationship to an adjacent corrugation. The end of the coupler is engaged onto one of the plurality of corrugations. The duct has a first longitudinal channel extending along an entire length of the duct and between adjacent pairs of corrugations. The duct has a second longitudinal channel extending along an entire length of the duct and between adjacent pairs of the corrugations. Each of the first and second longitudinal channels has an end opening interior of the coupler. The longitudinal channels and the plurality of corrugations each open to the interior passageway of the duct.

In the present invention, the coupler has an interior passageway extending between the ends thereof. The coupler has an inlet opening to the interior passageway of the coupler. The inlet is positioned between the ends of the coupler. A grout tube is affixed to this inlet. The grout tube extends outwardly of the coupler. The inlet has a threaded connection formed therein. The grout tube has an end threadedly received by this threaded connection.

The tendon has an end which extends outwardly of an end of the anchor opposite the coupler. A pair of wedges are placed in interference-fit relationship between a surface of the tendon and an inner wall of a cavity formed in the anchor. A cap is affixed to the anchor and extends over and around this end of the tendon. A grout material will fill an interior of the duct around the tendon therein. The coupler has a wide diameter portion extending over an end of the duct and a narrow diameter portion extending over the tubular extension of the anchor.

The present invention is also an anchor assembly for a bonded monostrand post-tension which comprises an anchor having a tubular extension extending outwardly from one end thereof, and a coupler having a first end affixed over the tubular extension in interference-fit relationship therewith. The coupler is axially aligned with the longitudinal axis of the tubular extension. The coupler has an interior passageway extending therethrough. The tubular extension is unthreaded such that the internal thread of the coupler self-taps onto the tubular extension. The coupler has a second end formed opposite the first end. This second end has an internal thread formed therein. The coupler also has an inlet passageway in communication with the interior passageway thereof. The inlet passageway is positioned between the first and second ends of the coupler. The inlet passageway has a connection area formed therein. A grout tube has one end received within the connection area of the inlet passageway. The grout tube extends outwardly therefrom. The inlet passageway has a longitudinal axis extending transverse to the interior passageway of the coupler.

DETAILED DESCRIPTION OF THE INVENTION

Figures 1, 2:
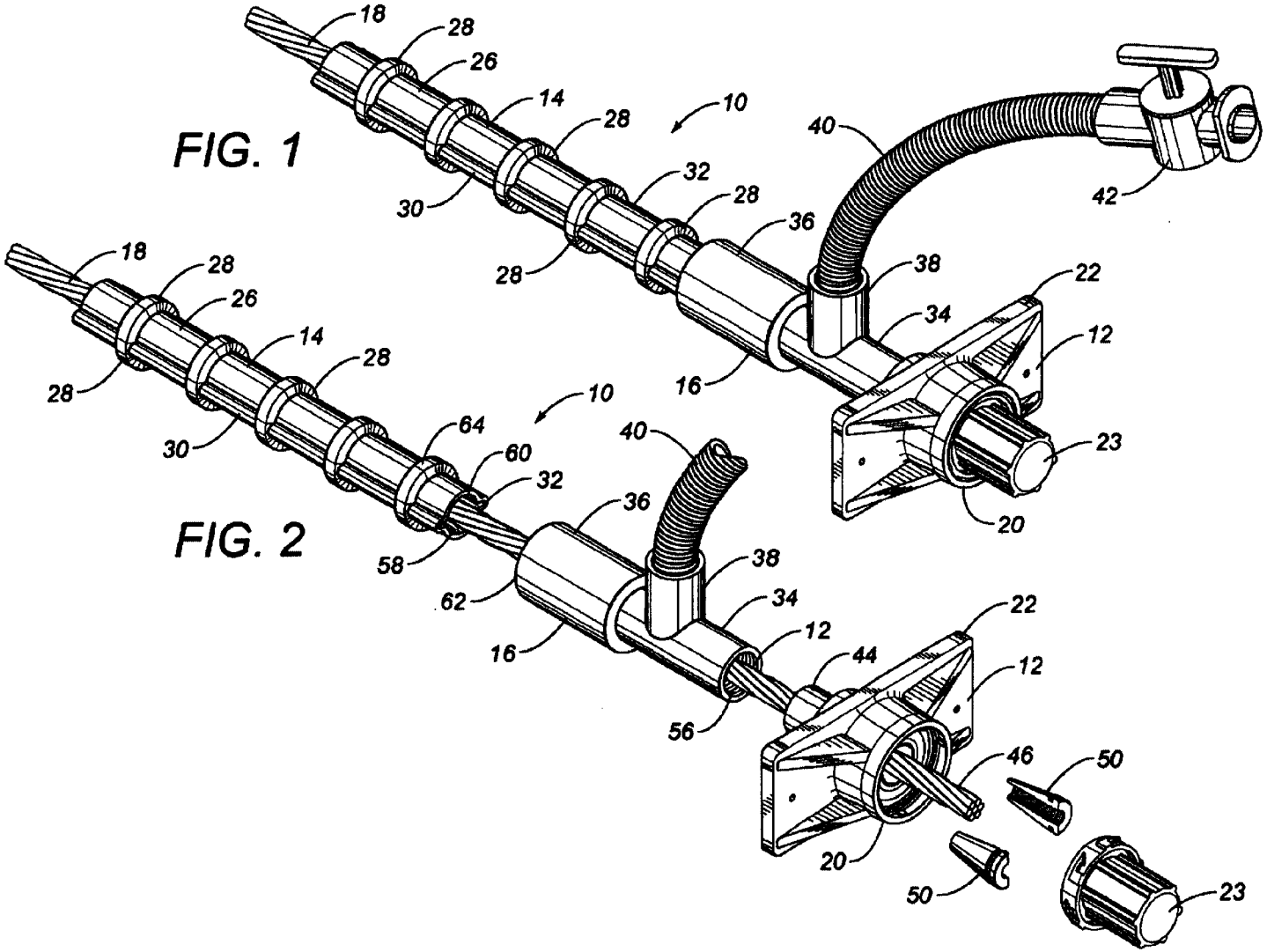
FIG. 1 shows a perspective view of the bonded monostrand post-tension system in accordance with the preferred embodiment of the present invention.
FIG. 2 shows an exploded view of the bonded monostrand post-tension system of FIG. 1.

Referring to FIG. 1, there is shown the bonded monostrand post-tension system 10 in accordance with the teachings of the preferred embodiment of the present invention. The system 10 includes an anchor 12, a duct 14, a coupler 16 having a one end affixed to the anchor 12 and an opposite end affixed to the duct 14, and a single tendon 18 secured to the anchor 12 and extending through the coupler 16 and the duct 14.

In FIG. 1, it can be seen that the anchor 12 is a common type of post-tension monostrand anchor. The anchor 12 is an encapsulated anchor whereby a steel anchor is encapsulated, through an injection molding process, with a polymeric encapsulation. The anchor 12 is of a type commonly sold by General Technologies, Inc, under license by the present inventor. The anchor 12 includes a cylindrical extension 20 extending outwardly from one side of the anchor plate 22 of anchor 12. The cylindrical extension 20 receives a cap 23 therein. In normal use, the cap 23 will be in sealed relationship with the cylindrical extension 20 and over the end of the tendon 18 which extends outwardly of the anchor plate 22. As will be described hereinafter, a tubular extension will extend outwardly of the anchor plate 22 on an opposite side of the anchor plate 22 from the cylindrical extension 20.

The duct 14 is a monostrand duct having a tubular body 26 with a plurality of corrugations 28 extending outwardly therefrom. A first longitudinal channel 30 extends along the length of the tubular body 26 so as to connect the corrugations 28 together. Similarly, a second longitudinal channel 32 extends on the opposite side of the tubular body 26 from the first longitudinal channel 30. The second longitudinal channel 32 will also connect with the corrugations 28. The arrangement of longitudinal channels 30 and 32, along with the arrangement of the plurality of corrugations 28, allows the grout material to fully fill and flow throughout the interior of the tubular body 26 of duct 14. Conventionally, the tubular body 26 will extends entirely over the exterior surface of the tendon 18. In FIG. 1, the tendon 18 is simply shown in broken graphical fashion as extending outwardly beyond an end of the duct 14. In actual practice, the duct 14 will extend for the entire length of the tendon 18.

The coupler 16 has a narrow diameter portion 34 and a wide diameter portion 36. One end of the narrow diameter portion 34 will be secured to the tubular extension of the anchor 12. An end of the wide diameter portion 36 will be secured over one of the corrugations 28 of the duct 14. The wide diameter portion 36 and the narrow diameter portion 34 will be in axial alignment. An inlet 38 is formed on the coupler 16 and extends generally transverse to the narrow diameter portion 34 and the wide diameter portion 36. The inlet 38 includes a suitable connection therein whereby a flexible grout tube 40 can be secured therein. Grout tube 40 extends outwardly of the inlet 38 and includes a valve mechanism 42 at an end thereof opposite the inlet 38. Valve mechanism 42 is suitable for allowing grout to be introduced into the interior of the coupler 16 and into the interior of the duct 14. In normal use, the grout will flow throughout the interior of the coupler 16 and the duct 14 so as to proper cement the tendon 18 in its position within the duct 14.

FIG. 2 shows an explodes view of the post-tension system 10. In FIG. 2, it can be seen that the anchor 12 has tubular extension 44 extending outwardly from a side of the anchor plate 22 opposite the cylindrical extension 20. The end 46 of the tendon 18 is illustrated as extending outwardly of the cylindrical extension 20. A cavity 48 is formed in the anchor 22 so as to allow the end 46 of the tendon 18 to extend therethrough. In order to secure the tendon 18 in its desired position within the anchor 12, a pair of wedges 50 are secured in interference-fit relationship between the exterior surface of the end 46 of tendon 18 and the inner wall of the cavity 48. A suitable tensioning force can be applied so that the post-tension system will achieve its desired compressive stress. The cap 23 has an insert portion 52 which is received within the interior of the cylindrical extension 20. In normal use, the 23 can be filled with a sealant and will extend over and around the end 46 of the tendon 18. As such, the unsheathed end 46 of tendon 18 will reside in a sealed manner within the anchor 12.

The coupler 16 is illustrated in FIG. 2 as having an internal thread 54 within the end of the narrow diameter portion 34. The thread 54 will engage the unthreaded tubular extension 44 of anchor 12. During a normal installation procedure, the coupler 16 can simply be pressed onto the tubular extension 44 and rotated so that the internal threads 54 will self-tap onto the unthreaded exterior surface of the tubular extension 44 and such that the narrow diameter portion 34 of the coupler 16 will reside in interference-fit relationship over the tubular extension 44.

The coupler 16 is illustrated as having the inlet 38 opening to the interior passageway 56 of the coupler 16. Inlet 38 extends so as to have an interior passageway in transverse relationship to the interior passageway 56. Grout tube 40 is affixed within the inlet 38 and extends outwardly therefrom.

In FIG. 2, it can be seen that the duct 14 has an interior passageway 58 formed therethrough. Interior passageway 58 extends longitudinally through the duct 14 and opens at end 60 of the duct 14. Similarly, the first longitudinal channel 30 and the second longitudinal channel 32 will also open at the end 60 of the duct 14. The longitudinal channels 30 and 32 facilitate the flow of grout through the interior of the duct 14. Ultimately, the longitudinal channels 30 and 32 will cause the grout to communicate between the various corrugations 28. The corrugations 28 extends radially outwardly of the tubular body 26 of duct 14. The plurality of corrugations 28 are in evenly spaced relationship to each other. This arrangement facilitates the ability to manufacture the duct 14 through an injection molding process.

In normal use, the end 60 of the duct 14 will reside within the wide diameter portion 36 of the coupler 16. The corrugation 28 will be secured to internal threads formed at the end 62 of the wide diameter portion 16. Since the outer surface 64 of the corrugation 28 is flat, this flat surface 16 is amenable to the self-taping caused by the threaded interior surface of the coupler 16. As a result, the corrugation 28 will reside in a sealed relationship within the wide diameter portion 36 of coupler 16. No additional sealing mechanisms are required.

Figure 3:
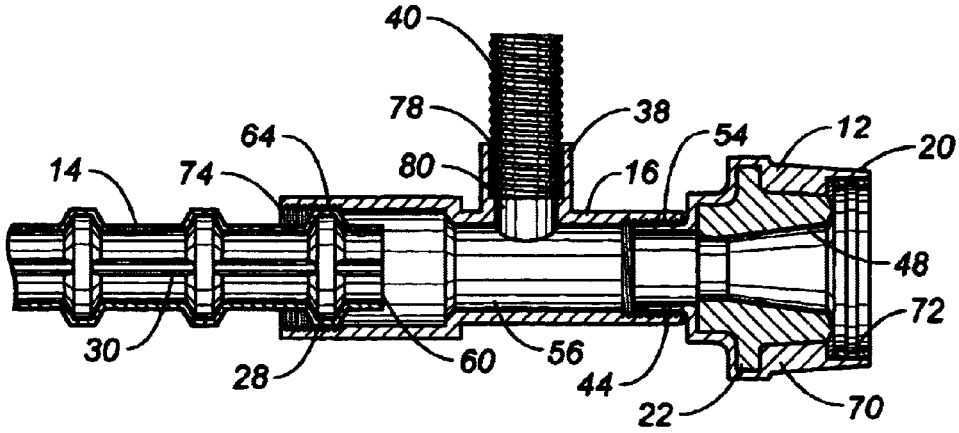
FIG. 3 is a cross-sectional view showing the connection between the coupler and the duct and the anchor of the bonded monostrand post-tension system of the present invention.

FIG. 3 actually shows the connections between the anchor 12 and coupler 16 and the duct 14 with the coupler 16. In FIG. 3, it can be seen that the encapsulation material 70 extends over and around the anchor plate 22. The tubular extension 44 is formed of the encapsulation material 70 so as to extend outwardly on one side of the anchor plate 22. The cylindrical extension 20 is also formed of the encapsulation material 70 so as to define a receptacle area 72 for the receipt of the cap 22 therein.

Importantly, the internal threads 54 at one end of the coupler 16 will engage the unthreaded exterior surface of the tubular extension 44 in a secure interference-fit relationship. Typically, the coupler 16 will be formed of a polymeric material that is harder than the polymeric material used for the encapsulation 70. As such, the internal threads 54 will dig into the unthreaded exterior surface of the tubular extension 44 and self-tap onto such surface. Ultimately, with sufficient turns of the coupler 16, the end of the coupler 16 will be engaged over the tubular extension 44 in the manner illustrated in FIG. 3.

FIG. 3 also shows that the duct 14 has a corrugation 28 threadedly received by the internal threads 74 formed at the opposite end of the coupler 16 from the anchor 12. The flat surface 64 of the corrugation 28 facilitates the ability for the threads associated within internal thread 74 to grip and self-tap onto the corrugation 28. The end 60, along with the longitudinal channel 30, are illustrated as opening to the interior passageway 56 of the coupler 16. As can be seen, the duct 14 is configured in longitudinal alignment with the tubular extension 44 and the interior cavity 48 of the anchor 12.

The coupler 16 has inlet 38 with a threaded area 78 formed therein. The threading on the flexible exterior surface of the grout tube 40 is threadedly received by the thread 78 formed on the inlet 38. The inlet 38' defines an interior passageway 80 which extends transverse to the interior passageway 56 of coupler 16. As a result, grout can be introduced through the grout tube 40 so as to flow in both directions toward the anchor 12 and toward the duct 14. Ultimately, the grout will flow into the open end 60 of the duct 14 and over and around the tendon (not shown) within the duct 14.

Figure 4:
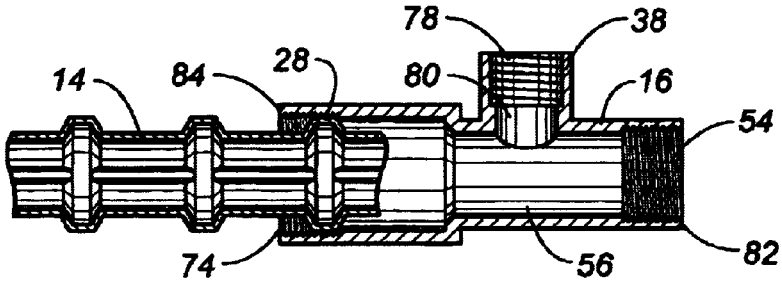
FIG. 4 is a cross-sectional view showing the connection between the coupler and the duct of the bonded monostrand post-tension system of the present invention.

FIG. 4 shows an isolated view of the coupler 16. In FIG. 4, the internally threaded area 54 is particularly illustrated. The end 82 of the coupler 16 opens so as to allow the tubular extension 44 of the anchor 12 to be inserted therein. The interior passageway 56 will have one end opening at end 82. The inlet 38 is illustrated as having threaded area 78 formed therein. Inlet passageway 80 will extend generally transverse to the interior passageway 56. The opposite end 84 of the coupler 16 has threaded area 74 formed therein. The duct 14 is illustrated as having corrugation 28 threadedly secured within the end 84 of coupler 16.

Figure 5:
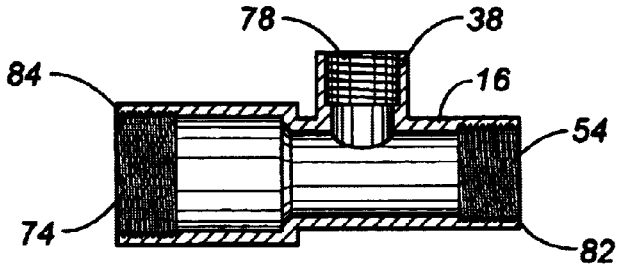
FIG. 5 is an isolated cross-sectional view of the coupler as used in the bonded monostrand post-tension system of the present invention.

FIG. 5 shows an isolated view of the coupler 16. In particular, in FIG. 5, the threaded area 54 at end 82 of coupler 16 is illustrated. Also shown is the threaded area 78 associated with inlet 38. Additionally, and furthermore, the opposite end 84 of the coupler 16 is illustrated as having internally threaded area 74 formed therein. The internally threaded area 74 is positioned so as to receive corrugation 28 of the duct 14 therein.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A bonded monostrand post-tension system comprising:

an anchor having a tubular extension extending therefrom;

a duct having a longitudinal axis, said duct having an interior passageway formed therein;

a coupler having a one end affixed to said tubular extension of said anchor and another end affixed to said duct; and a single tendon secured to said anchor and extending through said duct and said coupler, said coupler having a first internal thread at one end and a second internal thread at another end, said first internal thread engaged with said tubular extension of said anchor, said second internal thread engaged with an exterior surface of said duct.

2. The system of claim 1, said duct having a corrugation extending outwardly therefrom, said second internal thread affixed to said corrugation.

3. The system of claim 1, said anchor having a polymeric encapsulation extending thereover, said tubular extension being formed by said polymeric encapsulation, said first internal thread being self-tapped onto said tubular extension.

4. The system of claim 1, said one end of said coupler being in interference-fit relationship with said tubular extension, said another end of said coupler being in interference-fit relationship with said duct.

5. The system of claim 1, said duct being a tubular body having a plurality of corrugations extending outwardly therefrom along an exterior surface thereof, each of said plurality of corrugations being in spaced relationship to an adjacent corrugation, said another end of said coupler being engaged onto one of said plurality of corrugations.

6. The system of claim 5, said duct having a first longitudinal channel extending along an entire length of said duct and between adjacent pairs of the corrugations, said duct having a second longitudinal channel extending along an entire length of said duct and between adjacent pairs of the corrugations, each of said first and second longitudinal channels having an end opening interior of said coupler, each of said first and second longitudinal channels and each of said plurality of corrugations opening to said interior passageway of said duct.

7. The system of claim 1, said tendon having an end extending outwardly of an end of said anchor opposite said coupler, the system further comprising:

a pair of wedges in interference-fit relationship between a surface of said tendon and an inner wall of a cavity formed in said anchor; and a cap affixed to said anchor and extending over and around said end of said tendon.

8. The system of claim 1, further comprising:

a grout material filling an interior of said duct and around said tendon therein.

9. The system of claim 1, said coupler having a wide diameter portion extending over an end of said duct and a narrow diameter portion extending over said tubular extension of said anchor.

* * * * *